US008201353B1

(12) United States Patent
Swan

(10) Patent No.: US 8,201,353 B1
(45) Date of Patent: Jun. 19, 2012

(54) MODULAR HAND GUARD ASSEMBLY

(76) Inventor: Richard E. Swan, E. Bridgewater, MA (US)

( * ) Notice: Subject to any disclaimer, the term of this patent is extended or adjusted under 35 U.S.C. 154(b) by 241 days.

(21) Appl. No.: 12/687,832

(22) Filed: Jan. 14, 2010

Related U.S. Application Data

(60) Continuation-in-part of application No. 29/339,647, filed on Jul. 3, 2009, which is a division of application No. 29/330,753, filed on Jan. 14, 2009, now Pat. No. Des. 606,155.

(60) Provisional application No. 61/144,470, filed on Jan. 14, 2009, provisional application No. 61/144,471, filed on Jan. 14, 2009.

(51) Int. Cl.
*F41C 23/16* (2006.01)

(52) U.S. Cl. ..... 42/71.01

(58) Field of Classification Search ..... 42/71.01, 42/72, 73, 85, 90, 124
See application file for complete search history.

(56) References Cited

U.S. PATENT DOCUMENTS

| | | | | |
|---|---|---|---|---|
| 3,075,314 | A | 8/1960 | Bakker | |
| 4,536,982 | A | 8/1985 | Bredbury et al. | |
| 4,663,875 | A | 5/1987 | Tatro | |
| 4,689,911 | A | 9/1987 | White | |
| 4,742,636 | A | 5/1988 | Swan | |
| 4,845,871 | A | 7/1989 | Swan | |
| 5,142,806 | A | 9/1992 | Swan | |
| 5,198,600 | A | 3/1993 | E'Nama | |
| 5,276,988 | A | 1/1994 | Swan | |
| 5,343,650 | A | 9/1994 | Swan | |
| 5,533,292 | A | 7/1996 | Swan | |
| 5,590,484 | A | 1/1997 | Mooney et al. | |
| 5,613,316 | A | 3/1997 | Hightower | |
| 5,634,288 | A | 6/1997 | Martel | |
| 5,826,363 | A | 10/1998 | Olson | |
| 6,453,594 | B1 | 9/2002 | Griffin | |
| 6,490,822 | B1 | 12/2002 | Swan | |
| 6,499,245 | B1 | 12/2002 | Swan | |
| 6,508,027 | B1 | 1/2003 | Kim | |
| 6,609,321 | B2 * | 8/2003 | Faifer | 42/71.01 |
| 6,618,976 | B1 | 9/2003 | Swan | |
| 6,655,069 | B2 | 12/2003 | Kim | |
| 6,671,990 | B1 | 1/2004 | Booth | |
| 6,694,660 | B1 | 2/2004 | Davies | |
| 6,779,288 | B1 | 8/2004 | Kim | |
| 6,792,711 | B2 | 9/2004 | Battaglia | |
| 6,836,990 | B2 * | 1/2005 | Shiloni | 42/96 |
| 6,839,998 | B1 | 1/2005 | Armstrong | |
| 6,854,206 | B2 | 2/2005 | Oz | |
| 6,895,708 | B2 | 5/2005 | Kim et al. | |
| D507,620 | S | 7/2005 | Swan | |
| 7,059,076 | B2 | 6/2006 | Stoner et al. | |
| RE39,465 | E * | 1/2007 | Swan | 42/71.01 |
| 7,216,451 | B1 | 5/2007 | Troy | |
| D544,564 | S | 6/2007 | Swan | |

(Continued)

*Primary Examiner* — Michael Carone
*Assistant Examiner* — Jonathan C Weber
(74) *Attorney, Agent, or Firm* — Barlow, Josephs & Holmes, Ltd.

(57) ABSTRACT

A modular hand guard assembly serves both as a hand guard system and as an integrated interface system for mounting various weapon accessories and attachments thereto. The modular hand guard assembly includes a removable forward rail section that can be removed from the forward portion of the hand guard to provide for the installation of additional weapon accessories such as lights, optics or lasers in highly a desirable forward location adjacent to the barrel of the weapon. The modular hand guard assembly further includes a removable lower hand guard to provide access to the barrel of the firearm and an integrated modular switching and control system for use in connection with the various powered accessories mounted thereto.

24 Claims, 13 Drawing Sheets

U.S. PATENT DOCUMENTS

| | | | | |
|---|---|---|---|---|
| RE40,216 | E * | 4/2008 | Swan | 42/71.01 |
| 7,458,179 | B2 | 12/2008 | Swan | |
| 7,627,975 | B1 * | 12/2009 | Hines | 42/84 |
| 7,707,762 | B1 * | 5/2010 | Swan | 42/85 |
| 7,793,452 | B1 * | 9/2010 | Samson et al. | 42/72 |
| 7,941,959 | B1 * | 5/2011 | Swan | 42/85 |
| 2003/0074822 | A1 * | 4/2003 | Faifer | 42/71.01 |
| 2003/0230022 | A1 | 12/2003 | Battaglia | |
| 2004/0000083 | A1 | 1/2004 | Grant, Jr. | |
| 2004/0049964 | A1 | 3/2004 | Vais | |
| 2004/0226212 | A1 * | 11/2004 | Shiloni | 42/96 |
| 2005/0000142 | A1 | 1/2005 | Kim et al. | |
| 2005/0241211 | A1 | 11/2005 | Swan | |
| 2006/0010748 | A1 * | 1/2006 | Stoner et al. | 42/71.01 |
| 2006/0260169 | A1 | 11/2006 | Samson et al. | |
| 2007/0199435 | A1 | 8/2007 | Hochstrate et al. | |
| 2008/0301994 | A1 * | 12/2008 | Langevin et al. | 42/71.01 |
| 2010/0095575 | A1 * | 4/2010 | Swan | 42/72 |
| 2010/0126054 | A1 * | 5/2010 | Daniel et al. | 42/71.01 |
| 2010/0175293 | A1 * | 7/2010 | Hines | 42/71.01 |
| 2010/0269392 | A1 * | 10/2010 | Swan | 42/71.01 |
| 2011/0047850 | A1 * | 3/2011 | Rievley et al. | 42/72 |

* cited by examiner

MODULAR HAND GUARD ASSEMBLY

CROSS-REFERENCE TO RELATED APPLICATIONS

This application is related to and claims priority from earlier filed U.S. Provisional Patent Application No. 61/144,470, filed Jan. 14, 2009 and earlier filed U.S. Provisional Patent Application No. 61/144,471, filed Jan. 14, 2009. This application is also a continuation-in-part of pending U.S. application Ser. No. 29/339,647 filed Jul. 3, 2009, which is a division of issued U.S. Pat. No. D606155, filed Jan. 14, 2009 and issued Dec. 15, 2009.

BACKGROUND OF THE INVENTION

The present invention relates generally to a modular hand guard assembly for firearms. More specifically, the present invention relates to a modular assembly that is affixed to a firearm that facilitates integration and mounting of additional equipment onto a firearm.

In the general field of combat and commercial weaponry, numerous add-on enhancements have become available for attachment to standard firearms thereby significantly upgrading the capability of the firearm. One area within the broad scope of available firearms that is of particular interest is the M16/M4 weapon system typically utilized in military or law enforcement settings. Referring to FIG. 1, the M16/M4 weapon, generally indicated at 2, includes a lower receiver 3, an upper receiver 4, a butt stock 5 extending rearwardly from the upper and lower receivers 3,4, and a barrel 6 that is attached to the front of the upper receiver 4 and extends in a forward direction. The barrel 6 is held in position on the front of the upper receiver 4 by a barrel nut 7 (See FIG. 8) that is threaded onto a threaded barrel receiving receptacle (not shown) located on the front of the upper receiver 4. Most new models of the M16/M4 weapons also include a dovetail interface rail 8 integrally formed along the top of the upper receiver 4. This interface rail 8 provides a convenient mounting point for many of the available accessories for use with the M16/M4 firearm 2 such as scopes, sighting devices, lasers and directed fire devices. Since this interface rail 8 extends only along the upper receiver 4 the interface is limited in length to the length of the receiver 4. The difficulty is that many end users of this weapon system have multiple sighting devices in addition to a variety of lighting devices, accessory handgrips, etc. that are selectively attached to the weapon 2 for enhanced use of the weapon. Generally, there is not enough space on the interface rail 8 of the upper receiver 4 to accommodate all of the accessories that the user may desire to use.

In an attempt to overcome the space limitations, various methods and means have been developed for interchangeably attaching add-on enhancements to firearms. For example, U.S. Pat. No. 4,845,871 discloses a quickly detachable mounting interface for modular enhancements. Similarly, U.S. Pat. No. 5,142,806 discloses a universal receiver sleeve that increases the available rail space. More specifically, the sleeve has an extended upper interface rail with standard, universal dimensions regardless of the firearm and has a lower interface portion specific to a particular firearm. Another interface system is disclosed in U.S. Pat. No. 5,343,650 where an extended rigid interface frame is joined to a firearm receiver and extends forward about the firearm's barrel to a head assembly replacing the firearm's normal front sight. The distal end of the extended rigid frame receiver sleeve terminates in a front sight housing, which provides a housing for advanced laser and sensor components, and the standard front sight bead.

One of the continuing drawbacks of the prior art mounting systems is that they still do not provide enough room along the interface rails to allow multiple accessories to be used in conjunction with one another. Often, since one of the primary accessories used on the upper rail is an optical sight, most other accessories can't be mounted on the upper rail forward of the sight, because they end up blocking the sight. Further, as many of these devices are selectively moved onto and off of the upper rail, it is important that they can be replaced with a high degree of predictability with respect to their alignment (ability to repeat zero).

Accordingly, there is a clear need for an integration system that includes additional mounting interfaces for accessories that reduces interference with other accessories already residing on the upper rail mount. There is a further need of a modular hand guard assembly that provides an easily removed section that allows mounting of an accessory on the forward portion of the hand guard that positions the accessory out of the way of the various sighting devices already positioned on the upper rail. There is still a further need for a modular and integrated switching and control system for activating various electronic weapon accessories from a common location.

BRIEF SUMMARY OF THE INVENTION

In this regard, the present invention provides for a modular hand guard assembly that is mounted onto a firearm 2 that serves both as a hand guard system and as an integrated interface system for mounting various weapon accessories and attachments thereto. The present invention is particularly directed to an improved modular hand guard assembly that includes an upper hand guard and a removable forward rail section that can be removed from the upper hand guard to provide for the installation of additional weapon accessories such as lights, optics or lasers in highly a desirable forward location adjacent to the barrel of the weapon. Removal of the forward rail section reveals a cut out area configured and arranged to receive the rail section as well as other optional accessories. The modular hand guard assembly further provides for a removable lower hand guard for providing access to the barrel of the firearm and still further provides an integrated modular switching and control system for use in connection with various powered accessories.

At the forward end of the upper hand guard, there is a removable forward rail section that is received in a forward cutout area thereof. Adjacent to the cutout area there are opposing channels including lug formations provided to receive and retain the removable forward rail section. The forward end of the upper hand guard also includes opposing 3-position sliding locking pins positioned on either side thereof to engage respective locking notches on the forward end of the lower hand guard portion and respective locking notches on the forward end of the removable forward rail section. The sliding pins are similar to the conventional takedown pins as used to secure the upper and lower receiver portions of the firearm.

The forward rail section is removable for the purpose of mounting other weapon accessories in its place. For example, a drop-in light module may be provided that includes a complementary shape so as to be seated in the same cutout area or footprint as the removable forward rail section. In a preferred configuration, the body of the accessory has shape structure that complements the shape of the hand guard so as to not extend substantially outside the boundaries thereof and thereby not interfere with other accessories mounted on the adjacent rails.

While a light module is described herein, it is to be understood that the concept of providing drop-in weapon accessories applies to all types of weapon accessories, including lasers, range finders, video cameras, etc. It is contemplated that each such device would include a proprietary body shape to accommodate mounting within the footprint of the cutout area in the forward portion of the upper hand guard.

Still further, the switching and control system includes a bar-shaped switch body that is supported on the sidewall of the upper hand guard by a plurality of T-shaped standoffs that extend outwardly from the outer surface of the upper hand guard. The switch bar further includes ventilation holes that align with corresponding ventilation holes in the hand guard to maintain airflow and proper cooling through the interior of the hand guard. The switch bar is intended to control various weapon accessories, such as the weapon light as illustrated. However, the disclosure is not intended to be limited to the weapon light as illustrated. The switching system may be used to control anything electronic that is mounted to the weapon.

It is therefore an object of the present invention to provide an integration system that includes additional mounting interfaces for accessories that reduces interference with other accessories already residing on the hand guard. It is a further object of the present invention to provide a modular hand guard assembly that includes an easily removed section that allows mounting of an accessory on the forward portion of the hand guard that positions the accessory out of the way of the various sighting devices already positioned on the hand guard. It is still a further object of the present invention to provide a modular and integrated switching and control system for activating the various weapon accessories from a common location.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
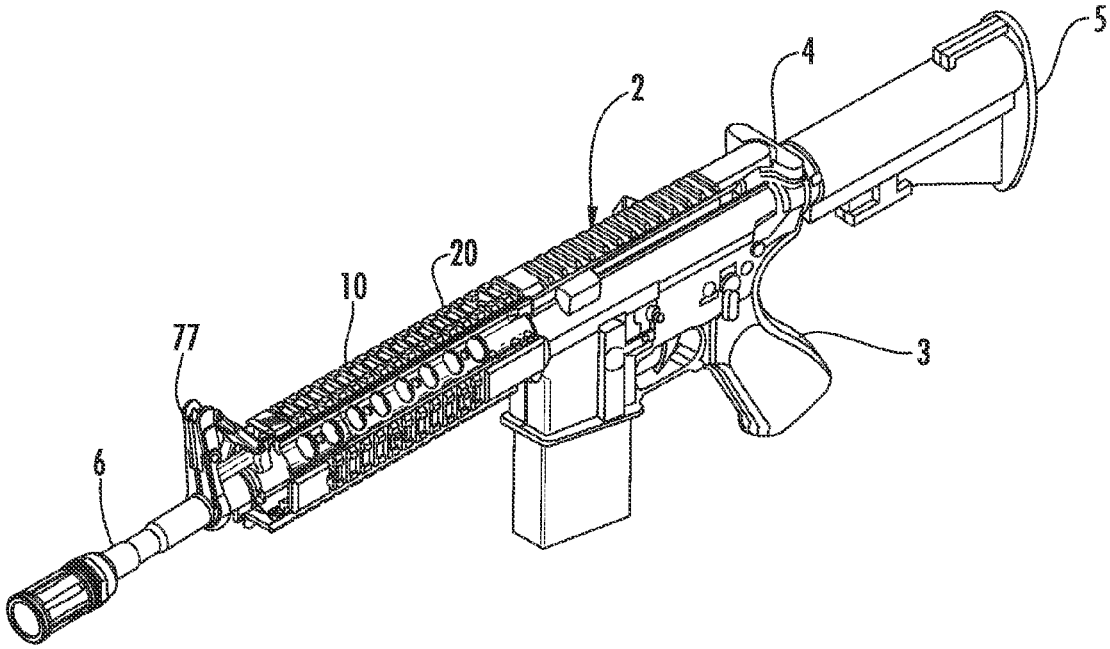
FIG. 1 is a front perspective view of the modular hand guard assembly of the present invention as mounted on a firearm.

Now referring to the drawings, the modular hand guard system is shown and generally indicated at 10 in the figures. As can be seen, the modular hand guard assembly 10 of the present invention generally includes an upper hand guard 11, a clamp 38 for affixing the upper hand guard 11 to the firearm 2, a lower hand guard 28 and a switching system 80.

Figure 2:
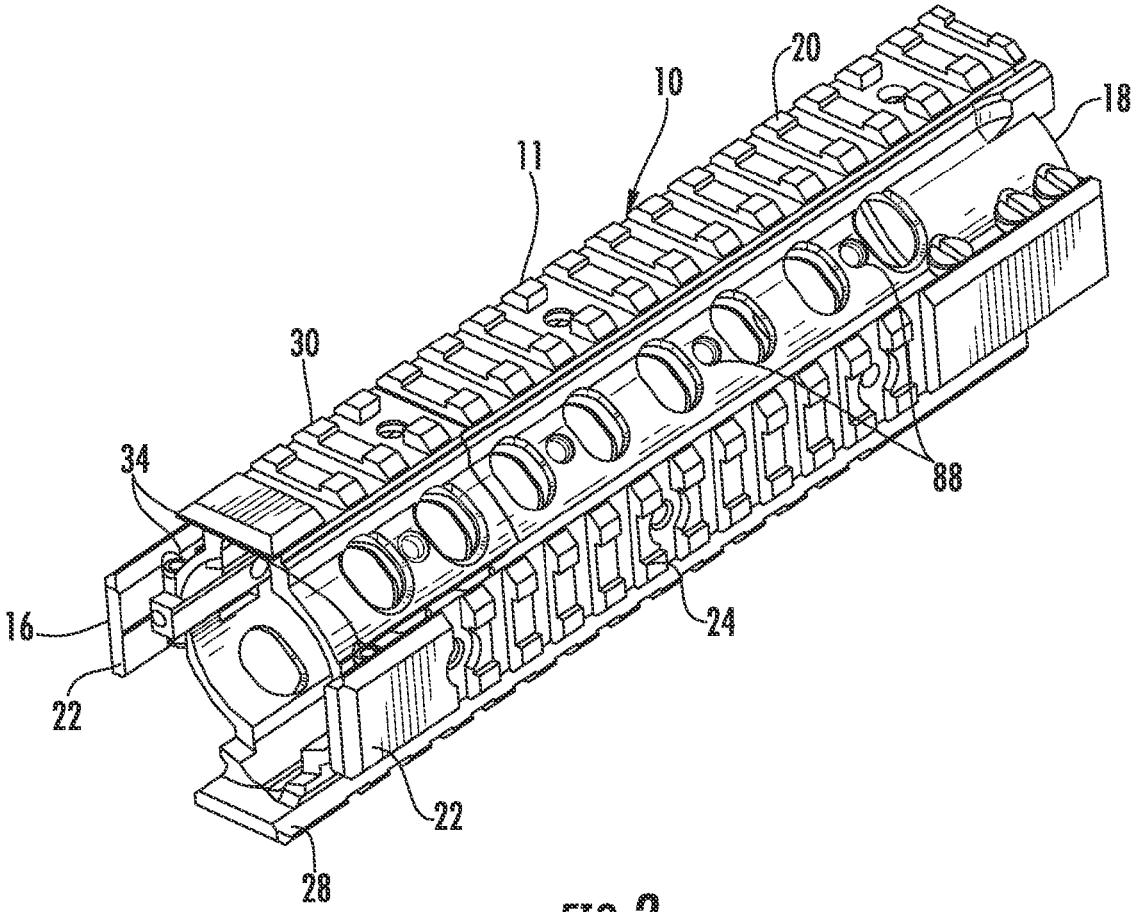
FIG. 2 is a front, perspective view of the modular hand guard assembly.

Turning now to FIGS. 1 and 2, the upper hand guard 11 is the primary structural element that supports the hand guard system 10 relative to the firearm 2. The upper hand guard 11 is formed generally as the upper half of a tubular enclosure that is configured to encircle the barrel 6 of the firearm 2 when in a mounted position. The upper hand guard 11 has a forward end 16 and a rearward end 18 and a standard dovetail rail 20 extending longitudinally between the forward end 16 and the rearward end 18. The upper hand guard 11 has left and right side walls 22 that extend generally outwardly and downwardly from the dovetail rail 20 forming the upper half of the substantially tubular enclosure. As can best be seen in FIG. 3, the left and right side walls 22 each have an interior and exterior surface and the walls 22 each terminate at their lower ends. The terminal ends of the walls include additional dovetail interface rails 24 extending along the exterior surface thereof and further include lower channels 26 and lug formations 27 on the interior surface thereof. The lower channels 26 and lug formations 27 as will be described in more detail below are provided to receive and retain the removable lower hand guard 28. Also included in the upper hand guard 11 is a groove (not shown) on the interior surface proximate the rearward end 18. The groove is configured to receive and capture the flange on the firearm barrel nut 7, so that the interior surface of the rearward end 18 of the upper hand guard 11 can sit flush on the outer surface of the barrel nut 7.

Figure 3:
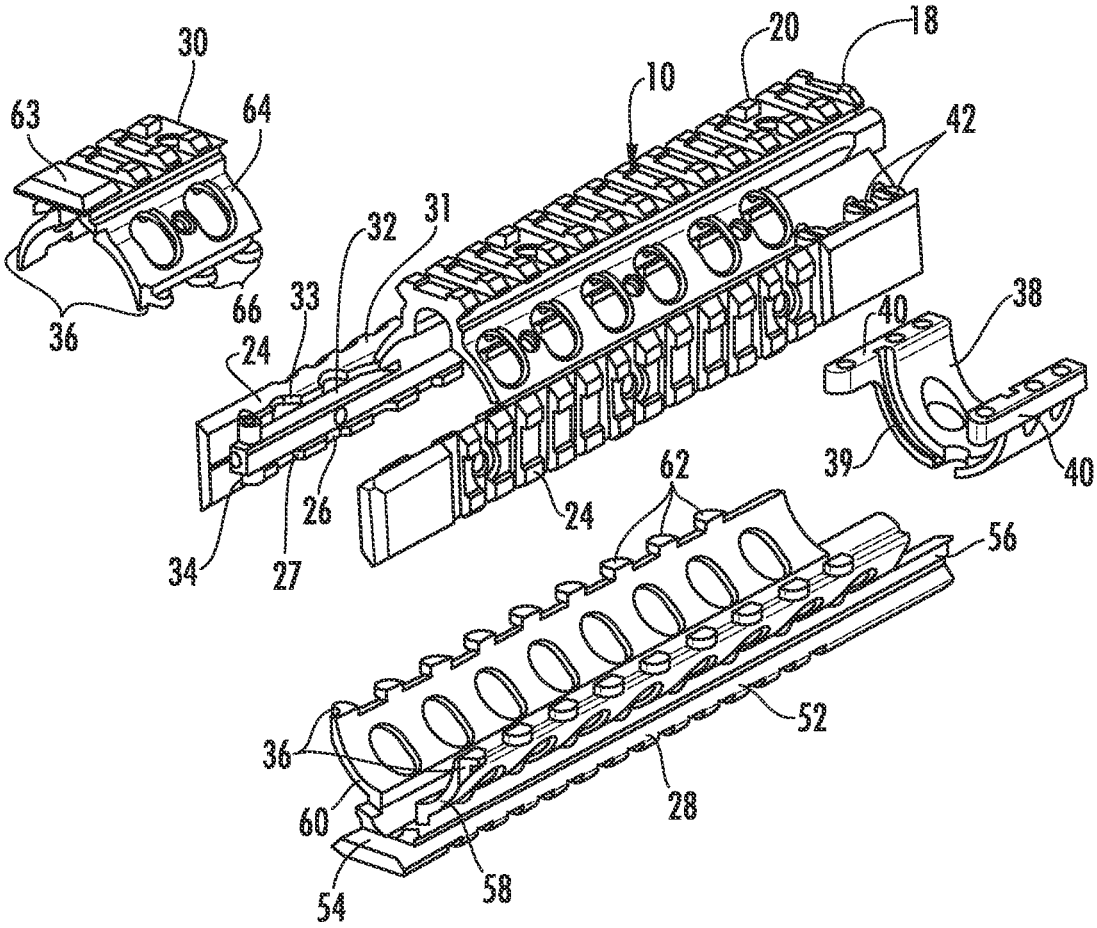
FIG. 3 is an exploded front, perspective view of the modular hand guard assembly.

At the forward end 16 of the upper hand guard 11, there is a removable forward rail section 30 that is received in a forward cutout area 31 thereof (see FIG. 3). Within the cutout area 31 there is an upper channel 32 and lug formations 33 provided to receive and retain the removable forward rail section 30. The upper channel 32 and lugs 33 further serves to receive and retain other weapon accessories as will be described in detail below.

The forward end 16 of the upper hand guard 11 also includes a pair of three position sliding locking pins 34 located on opposing sides thereof to engage respective notches 36 on the forward end of the lower hand guard 28, as well as notches 36 on the forward end of the removable forward rail section 30, the operation of which will be described in detail below. The sliding pins 34 are similar to the conventional takedown pins as used to secure the upper and lower receiver portions of the firearm.

Figure 4:
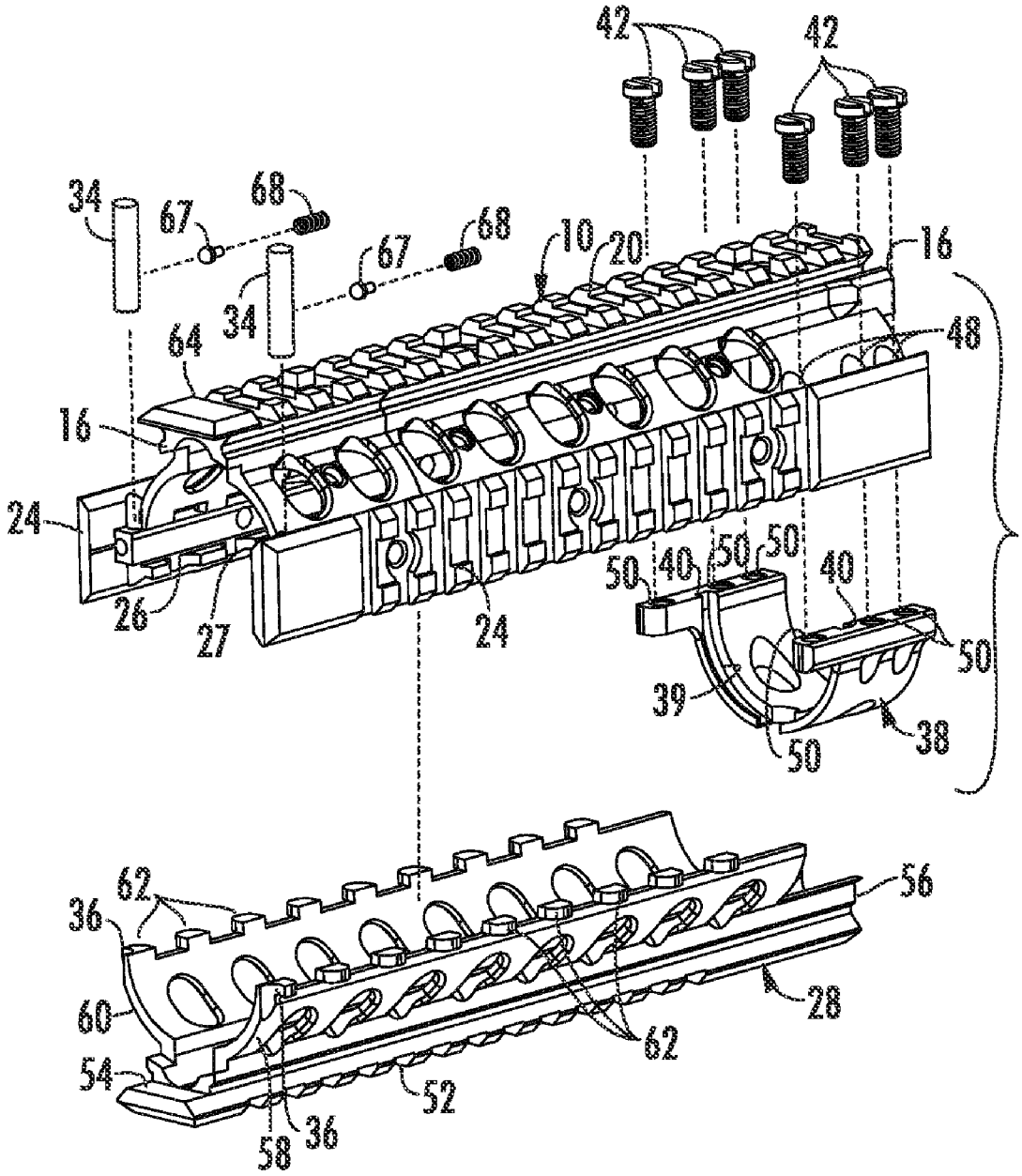
FIG. 4 is an exploded front, perspective view of the modular hand guard assembly showing details of the fastening arrangement.

Turning to FIGS. 3 and 4, a clamp 38 is provided at the rearward end 18 of the upper hand guard 11 in order secure the upper hand guard 11 to the firearm 2. Generally, the clamp 38 is configured to cooperate with the rearward end 18 of the upper hand guard 11 and to engage the outer surface of the existing barrel nut 7 on the firearm 2 and serves to support the entire hand guard assembly 10 by engaging the barrel nut 7. The clamp 38 has a central semi-circular recess 39 therein and a flange 40 extending out to each side thereof. The clamp 38 is attached to the rearward end 18 of the upper hand guard 11 with fasteners 42 that are inserted through openings 48 in the sidewalls 22 of the upper hand guard 11 into threaded holes 50 in the flanges 40 on the clamp 38. When the fasteners 42 are installed and tightened, the clamp 38 is drawn to the upper hand guard 11 and the two components cooperate to engage the barrel nut as well as the toothed flange (not shown) on the forward end of the barrel nut 7. This mounting configuration allows the clamp 38 and upper hand guard 11 to be mounted rigidly onto the firearm 2 while deriving all of the required structural support from the front of the upper receiver 4 and barrel nut 7 thereby eliminating any need to engage the barrel 6 of the firearm 2. In this manner, all of the weight of the modular hand guard system 10 and accessories that are mounted thereto is transferred effectively to the upper receiver 4 thereby protecting the barrel 6 from any additional transfer of load or shock.

It should be appreciated by one skilled in the art that while fasteners 42 are shown extending through the upper hand guard 11 and into the clamp 38, the fasteners 42 could also extend through the clamp 38 and into the upper hand guard 11 and still fall within the disclosure of the present invention.

While the preferred embodiment of the present invention is illustrated and described in connection with a hand guard system 10 having an upper hand guard 11 and a clamp 38 around the barrel nut 7, the concept of providing a removable rail section on the forward portion of the hand guard is equally applicable to any of the existing hand guard systems currently available on the open market regardless of the method of securing the hand guard to the weapon.

Likewise, while the preferred embodiment focuses on having the removable rail section located on the upper surface of the hand guard assembly, there is no reason why the same concept cannot be implemented to provide a removable rail section on the side portion, or the bottom portion, of the hand guard in systems for example, having monolithic tubular hand guards.

Nor should the teachings herein be limited to a removable rail section only at the forward end of the hand guard. It is equally possible to provide a removable rail section located in the middle of the hand guard as well as at the rear of the hand guard.

Turning back to the preferred embodiment, when the upper hand guard 11 is affixed to the barrel nut 7 and assembled adjacent the upper receiver 4, the interface rail 20 of the upper hand guard 11 is arranged so that it extends forwardly in linear alignment with the interface rail 8 of the upper receiver 4 to form a continuous rail extending forwardly over the barrel 6.

The lower hand guard 28 is formed in a substantially semi-circular shape that is complimentary to the upper hand guard 11 and completes a tubular enclosure around the barrel of the firearm 2 when the lower hand guard 28 is mounted to the upper hand guard 11. The lower hand guard 28 may also optionally include a longitudinal rail interface 52 extending from the front end 54 to the rear end 56. The lower hand guard 28 has sidewalls 58 and 60 that generally extend upwardly and outwardly therefrom and terminate in mating formations or mounting tabs 62 that are shaped and configured to engage the channels 26 and lugs 27 along the bottom edges of the sidewalls 22 of the upper hand guard 11. The lower hand guard 28 is therefore slidably engaged with the upper hand guard 11.

The forward end 54 of the lower hand guard 28 includes a pair of locking notches 36 on the forwardmost mounting tabs 62 on either side. The notches 36 are shaped to receive the lower end of the locking pins 34 on the forward end of the upper hand guard 11 to prevent the lower hand guard 28 from being slid out of engagement with the upper hand guard 11. When a user wishes to remove the lower hand guard 28, the locking pins 34 are moved upwardly clear of the notches 36 on the forward most mounting tabs 62 on the lower hand guard 28. With the locking pins 34 in this position the lower hand guard 28 may then be slid forward to disengage it from the upper hand guard 11. A user can use one hand to unlock the locking pins 34 and remove the lower hand guard 28.

The removable forward rail section 30 is also formed in a substantially semi-circular shape that is complimentary to the cross-sectional profile of the upper hand guard 11 and completes a tubular enclosure around the barrel 6 of the firearm 2 when the forward rail section 30 is mounted within the cutout area 31 of the upper hand guard 11. The forward rail section 30 preferably includes a longitudinal interface rail 63 extending from its front end to the rear end. Alternatively, the upper surface thereof could be shaped to accommodate other mounting configurations or surfaces. The forward rail section 30 has sidewalls 64 that generally extend downwardly and outwardly therefrom and terminate in mating formations or mounting tabs 66 that are shaped and configured to engage the upper channel 32 and lug formations 33 in the cutout area 31 at the forward end 16 of the upper hand guard 11. The removable forward rail section 30 is therefore slidably engaged with the upper hand guard 11.

As was described above with respect to the removable lower hand guard 28, the forward end of the forward rail section 30 also includes a pair of locking notches 36 on forward most mounting tabs 66 on either side. The notches 36 are shaped to receive the upper end of the locking pins 34 on the forward end of the upper hand guard 11 to prevent the forward rail section 30 from being slid out of engagement with the upper hand guard 11. When a user wishes to remove the forward rail section 30, the locking pins 34 are displaced downwardly to clear the notches 36 on the forward most mounting tabs 66 on the forward rail section 30. The forward rail section 30 may then be slid forward to disengage it from the upper hand guard 11. A user can use one hand to unlock the locking pins 34 and remove the forward rail section 30.

The locking pins 34 are retained in the upper hand guard 11 by spring-biased retaining pins 67. The retaining pins 67 each include a rounded head. Each locking pin 34 also includes a lateral slot (not shown) connecting two spaced lock holes (not shown). The lock holes are smaller in diameter than the retaining pin 67 to prevent the retaining pin 67 from becoming lodged within the lock holes. The rounded head of the retaining pin 67 travels within the lock slot on the locking pin 34 and becomes seated in either of the lock holes. Since the head of the retaining pin 67 becomes seated in the lock holes, the locking pin 34 is prevented from becoming easily dislodged. Moreover, the retaining pin 67 prevents the locking pin 34 from traveling freely within the upper hand guard 11, which could allow the lower hand guard 28 or firearm accessory to become detached from the upper hand guard 11. The rounded head of the retaining pin 67 allows a user to easily unseat the retaining pin 34 from the lock holes on the locking pin 34 by applying sufficient force on the locking pin 34 to bias the retaining pin 67 inwardly against a spring 68 in the upper hand guard 11. The locking pins 34 are movable through three positions, namely a neutral or locked position where the upper and lower ends of the pins 34 engage both the forward rail section 30 and the lower hand guard 28, an upper position where the pins 34 are disengaged from the lower hand guard 28 and a lower position where the pins 34 are disengaged from the forward rail section 30.

Figure 5:
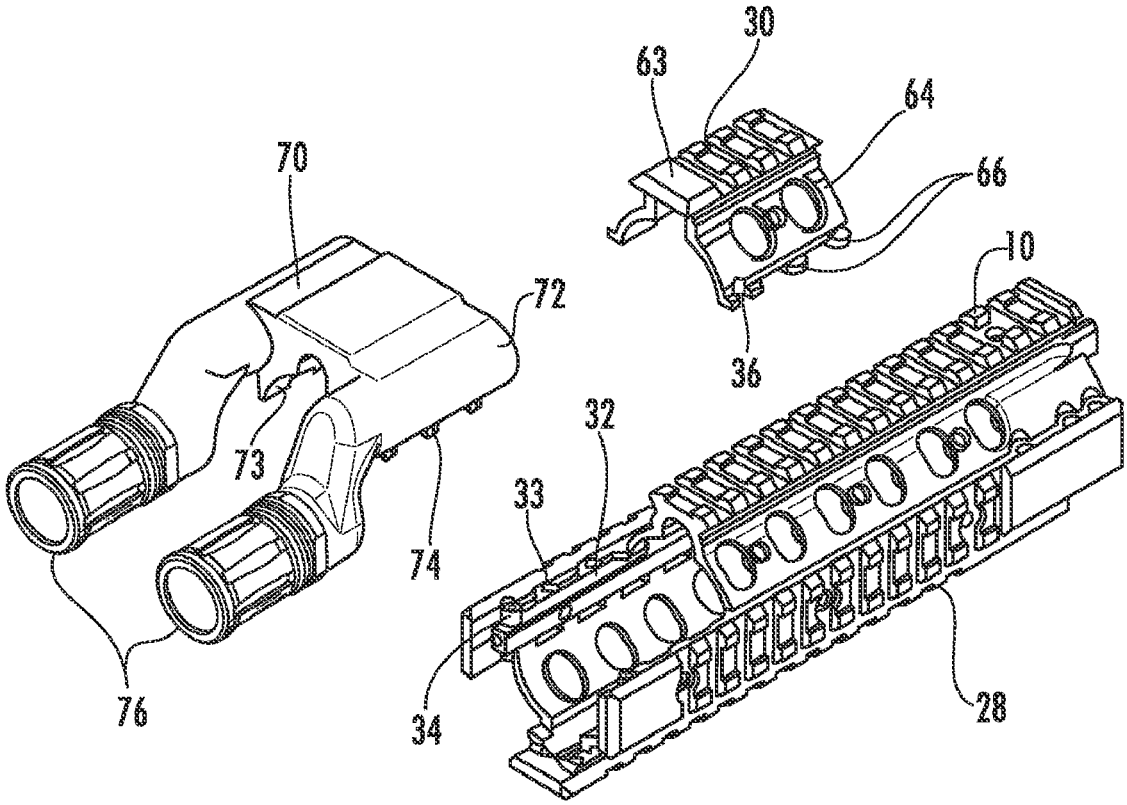
FIG. 5 is a front, perspective view of the modular hand guard assembly with the forward rail section removed and a drop in light accessory positioned above, ready for installation.
Figure 6:
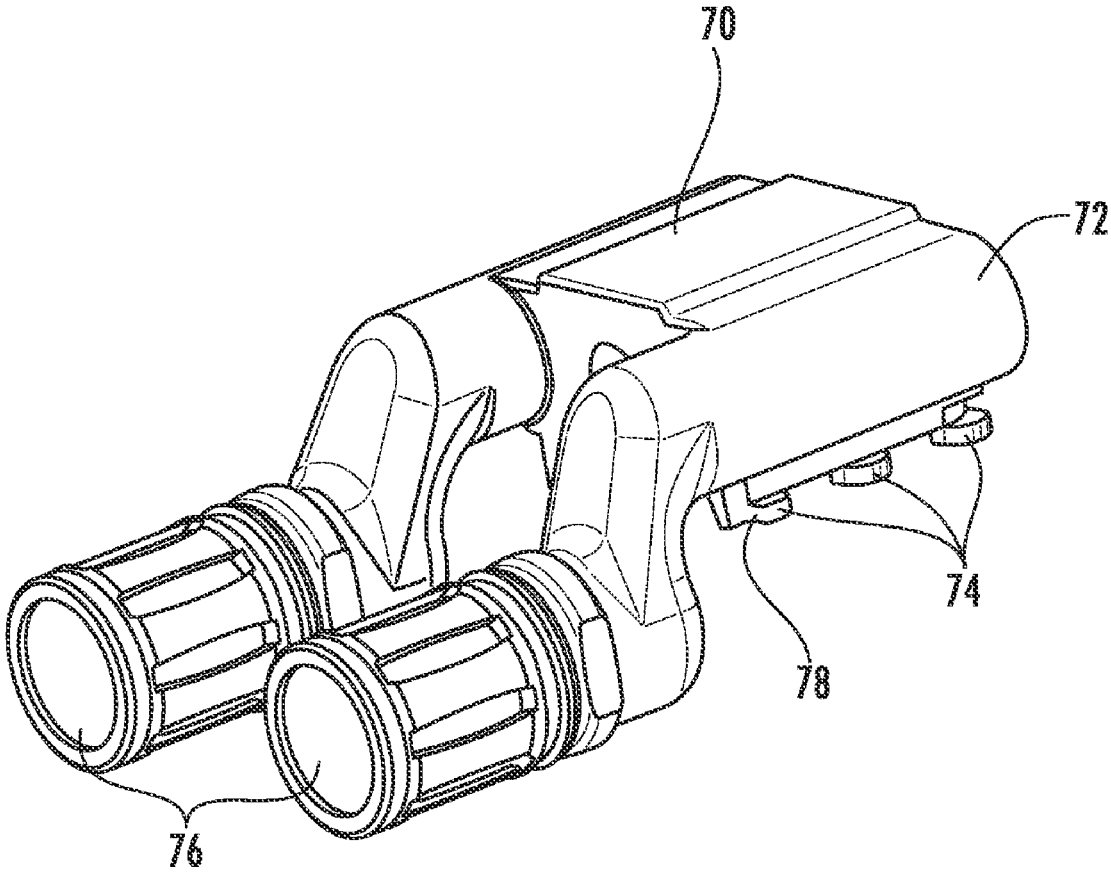
FIG. 6 is a front, perspective view of the drop in light accessory.
Figure 7:
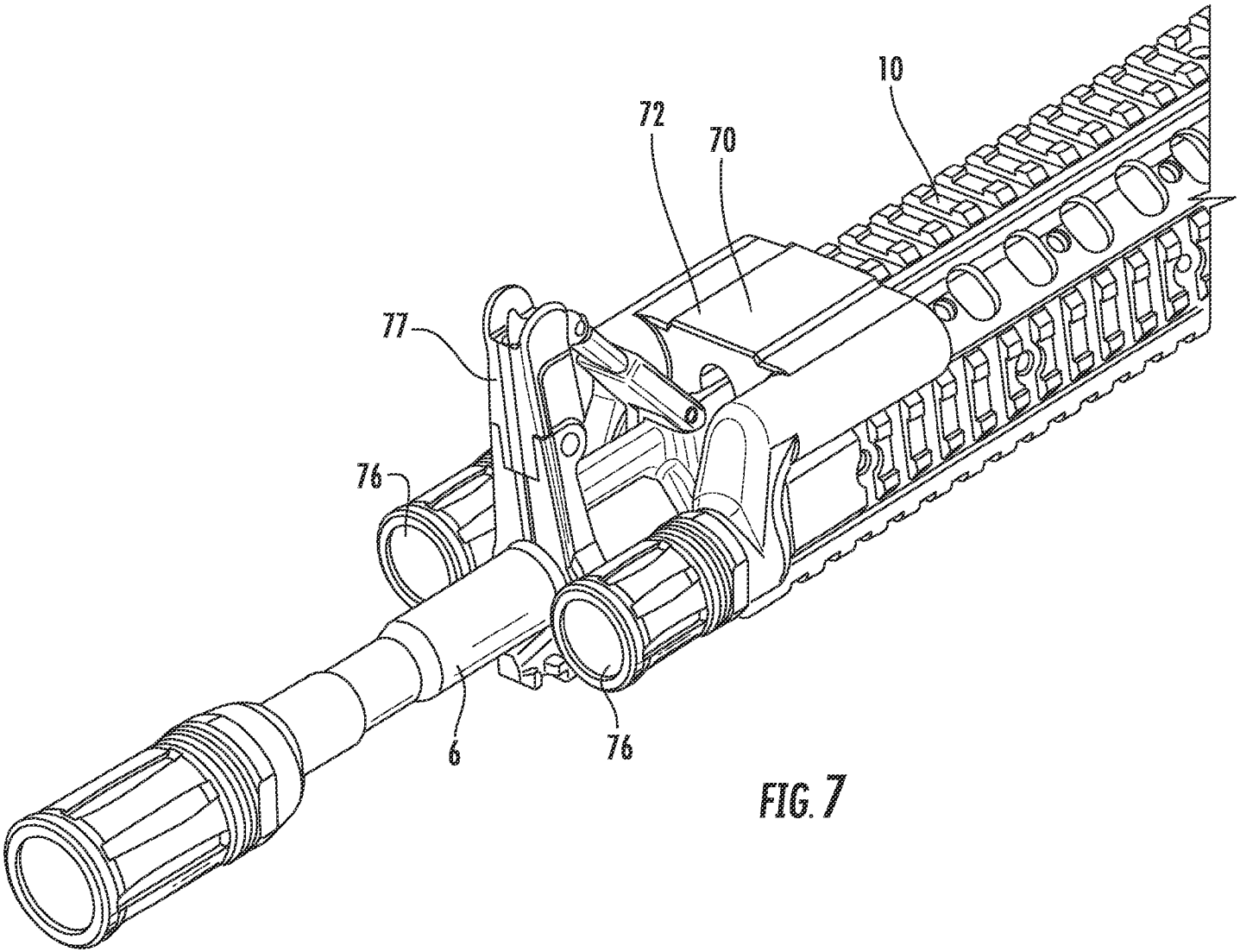
FIG. 7 is a partial front perspective view of the modular hand guard assembly of the present invention mounted on a firearm with the drop in light accessory installed.

Turning to FIGS. 5-7, the forward rail section 30 is removable for the purpose of mounting other weapon accessories in its place. In one embodiment as illustrated, a drop-in light module 70 includes a complementary body shape so as to be seated in the same cut-out area 31 or footprint, in the upper hand guard 11 from which the forward rail section 30 is removed. The drop-in light module 70 includes a body portion 72 having a lower surface formed in a semi-circular shape that is complimentary to the profile of the upper hand guard 11 and completes a tubular enclosure around the barrel 6 of the firearm 2 when the drop-in 70 light is mounted to the upper hand guard 11. The body 72 includes sidewalls 73 that generally extend downwardly and outwardly therefrom and terminate in mating formations or mounting tabs 74 that are shaped and configured to engage the upper channel 32 and lug formations 33 at the forward end of the upper hand guard 11. The drop-in light module 70 is therefore slidably engaged with the upper hand guard 11 in the same manner as described above with respect to the removable forward rail section 30. Similar to the forward rail section 30, the forward most mounting tabs 74 on either side include notches 78 for receiving the locking pins 34 that in turn prevent the drop in light 70 from being dislodged.

Two spaced light heads 76 extend downwardly and forwardly from the body portion 72 of the light module 70 so that they are positioned adjacent to the barrel 6 of the weapon 2 when mounted on the upper hand guard 11. The unique positioning of the light module 70 on the forward portion 16 of the upper hand guard 11 allows the light heads 76 to be positioned in closely aligned relation to the barrel 6 and generally forward of the front sight 77. Positioning of a light behind the front sight 77 is known to create shadows in the beam circle of the light in use, i.e. the front sight blocks a portion of the light beam because the light is behind the sight 77. The present configuration allows the light to be mounted in a position where the head 76 is dropped down to the side and forward of the front sight. Further, by providing symmetrical light heads 76 on opposing side of the sight 77, any resulting shadows from the barrel 6 are offset by light from the opposing side.

While a light module is specifically described herein, it is to be understood that the concept of providing drop-in weapon accessories applies to all types of weapon accessories, including but not limited to visible lights, infrared illuminators, lasers, range finders, accessory weapons, tasers, video cameras, etc. It is contemplated that each such device would include a body shape that matches the forward rail section 30 in order to accommodate mounting within the cutout area 31 or footprint in the forward portion 16 of the upper hand guard 11.

Figure 8:
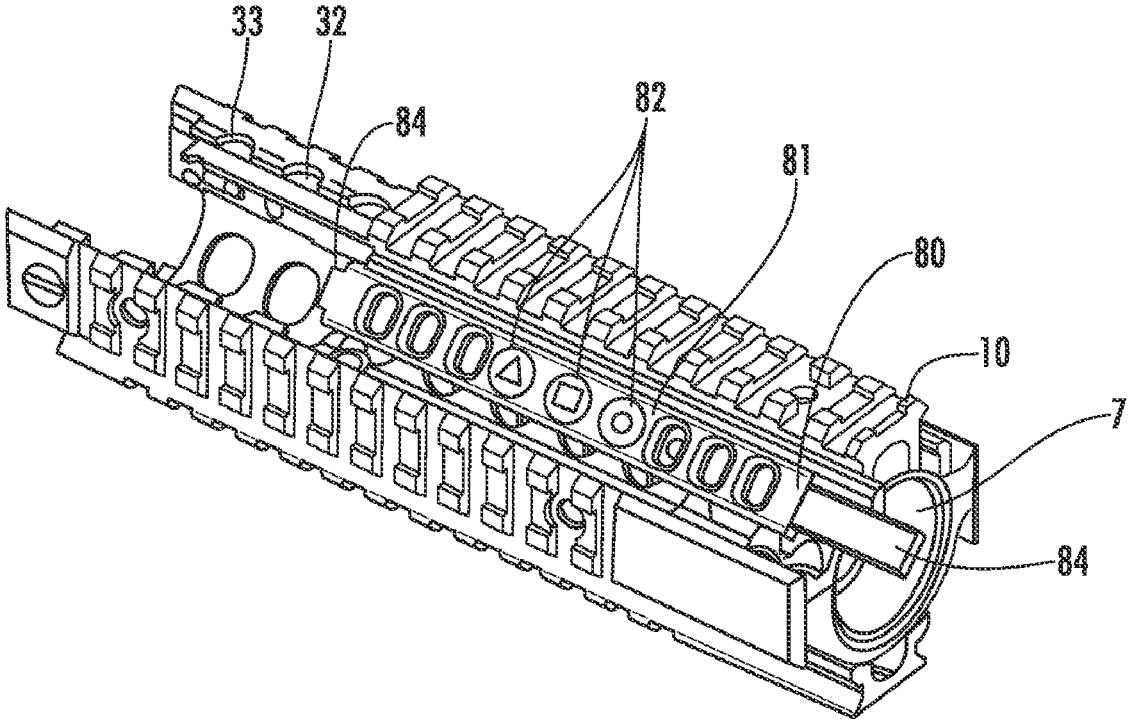
FIG. 8 is a front, perspective view of the modular hand guard assembly with the switch bar installed thereon.

Turning now to FIG. 8, the switching system 80 comprises an elongated bar-shaped housing 81. The housing 81 may be formed from a metal, a plastic or a flexible polymer material. The housing 81 includes a plurality of switches 82 spaced longitudinally along the length thereof. The switches 82 are preferably dome switches that are housed within and covered by the plastic material. The dome switches 82 are preferably connected to wires (not shown) or conductive leads that run along the interior of the housing 81. The specific configuration of the switches 82 and wires required to accomplish the functions of this switching system is well within the knowledge of one skilled in the art, and further specific details thereof will not be described.

The conductive leads terminate in a connection port 84 at one or both ends of the housing 81. The connection port 84 is modular such that accessories or additional lengths of switch bar housing 81 can be plugged into the connection port 84 as will be described in more detail below.

Figure 9:
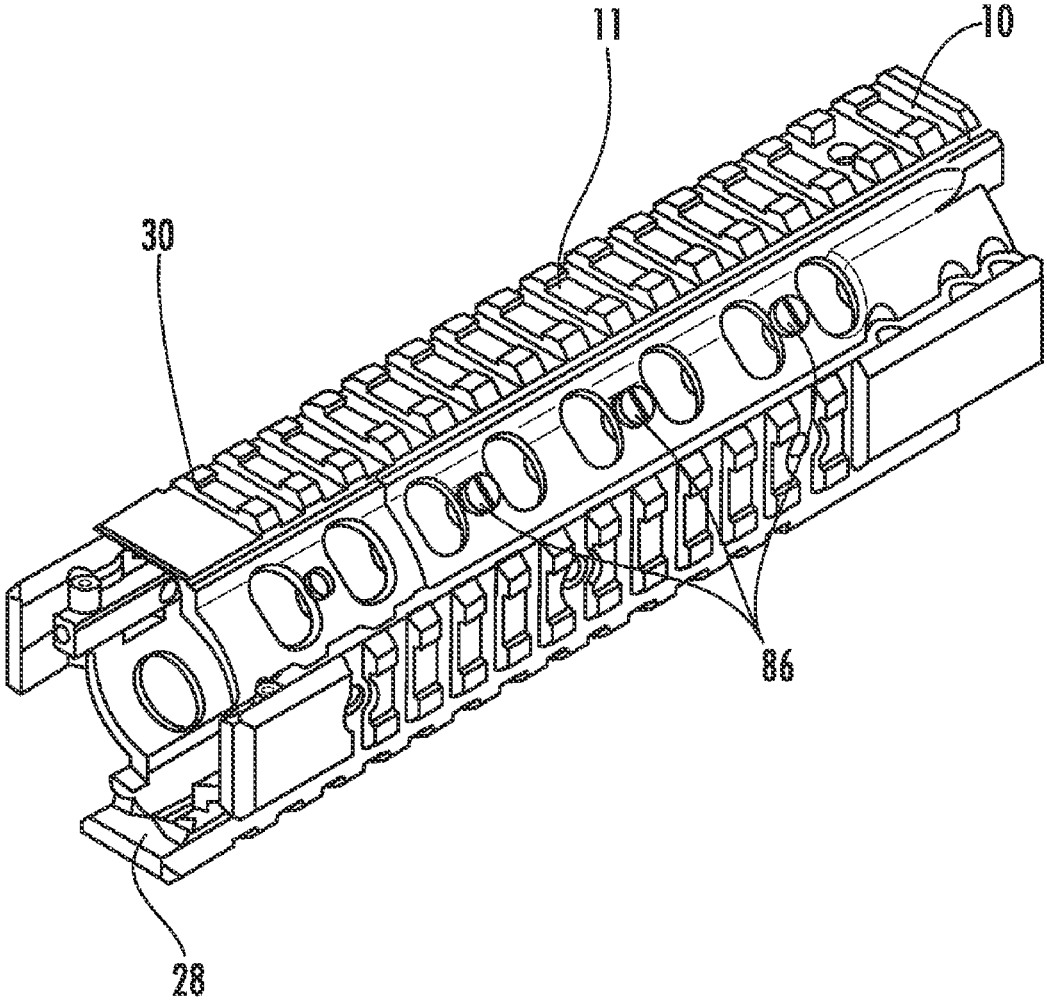
FIG. 9 is a front, perspective view of the modular hand guard assembly depicting the standoffs for receiving the switching bar.
Figure 10:
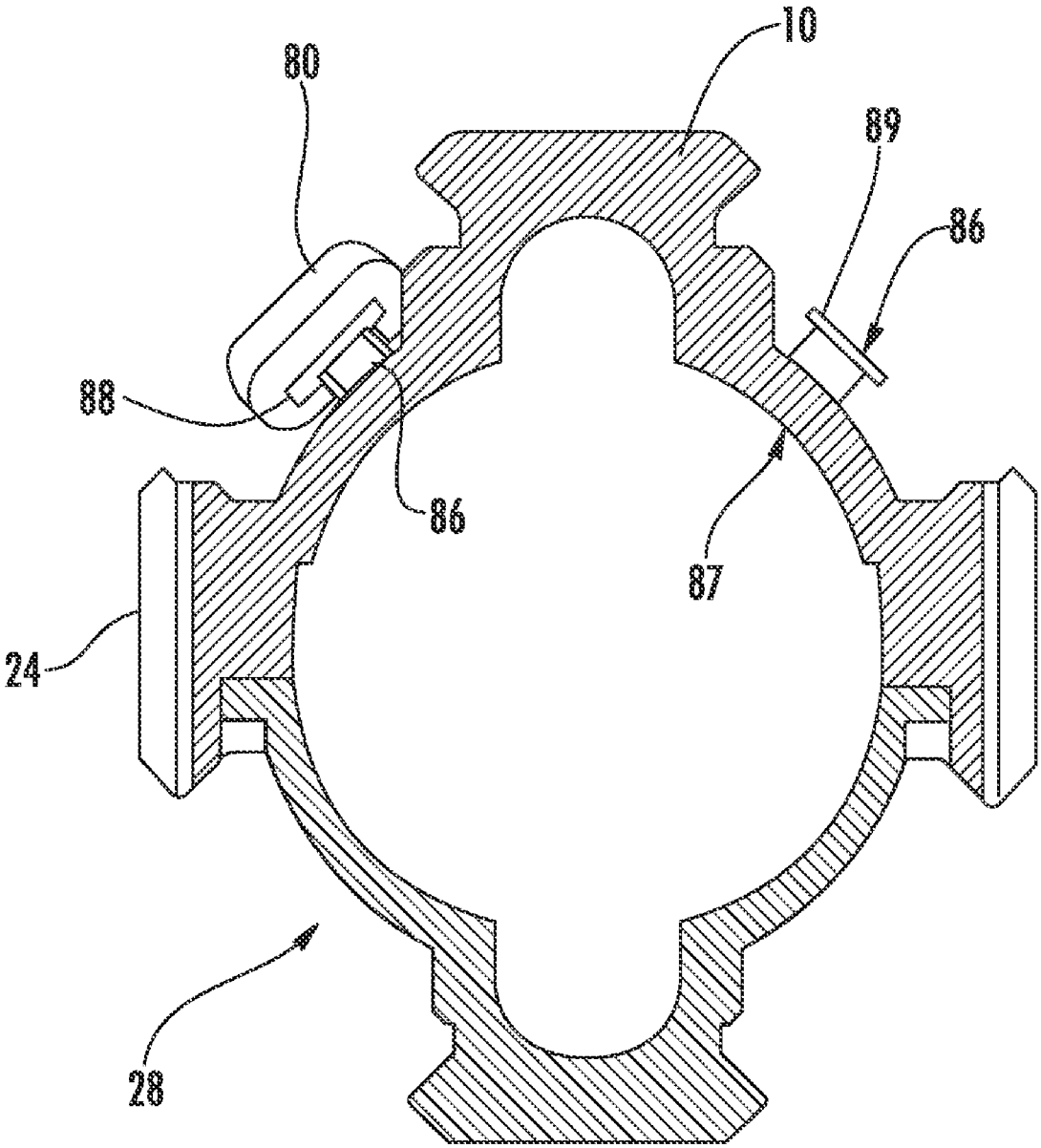
FIG. 10 is an end view of the modular hand guard assembly with the switching bar installed in an alternate position thereon.
Figure 11:
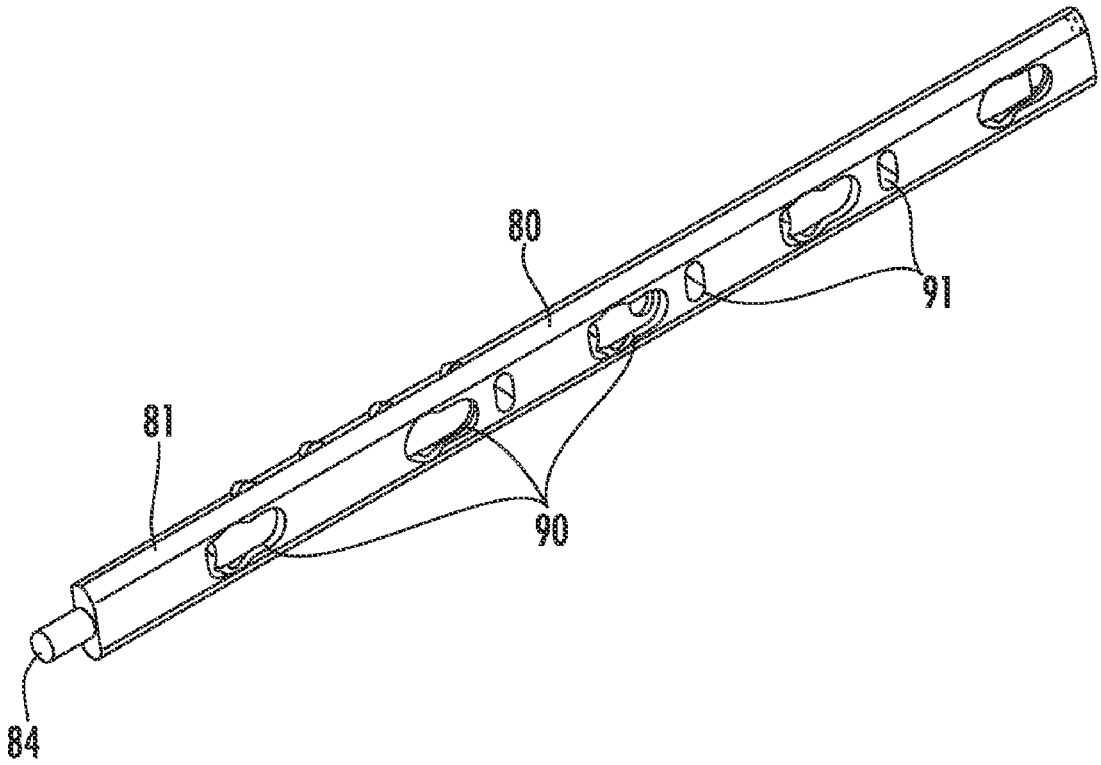
FIG. 11 is a front, perspective view of the switch bar.

The switch bar housing 81 is supported on the sidewall of the upper hand guard 11, as can best be seen in FIG. 9, by a plurality of standoffs 86 that extend outwardly from the outer surface of the upper hand guard 11. The standoffs 86 are preferably T-shaped and have threaded posts 87 that are received into corresponding threaded openings 88 in the sidewalls 22 of the upper hand guard 11. The upper ends of the standoffs 86 have a slotted flat head 89, similar to a screw head. As shown in FIG. 10, the heads of the standoffs 86 are slidably received into corresponding slots 90 on the back surface of switch bar housing 81 to removably mount the switch bar housing 81 in position. It should be noted that the standoffs 86 may be positioned on either side of the hand guard 11, or on the lower hand guard 28 so that the switch bar housing 81 can be located at various positions around the outer surface of the hand guard 11. In FIG. 11, the switch bar housing 81 can further be seen to optionally include ventilation holes 91 that align with corresponding ventilation holes in the hand guard 11 to maintain airflow and proper cooling through the interior of the hand guard 11.

Figure 12:
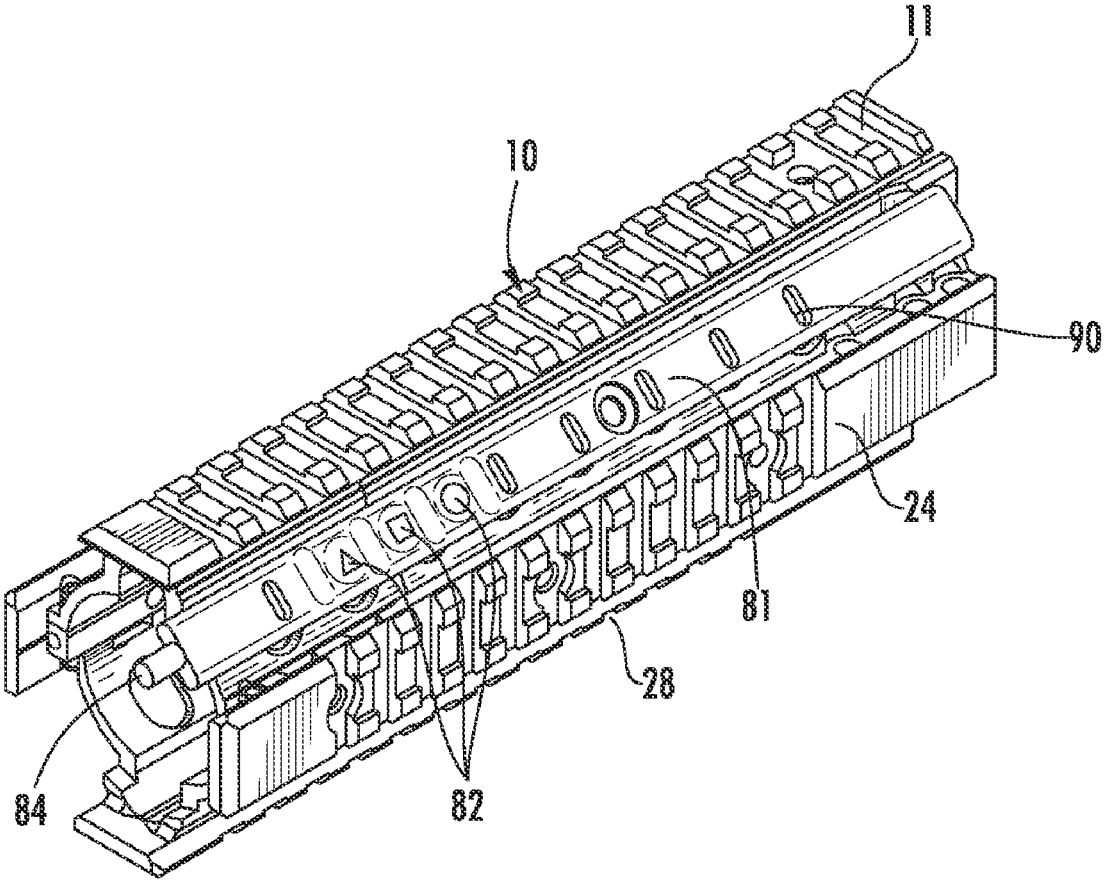
FIG. 12 is a front, perspective view of the modular hand guard assembly with an alternate embodiment switch bar installed thereon.
Figure 13:
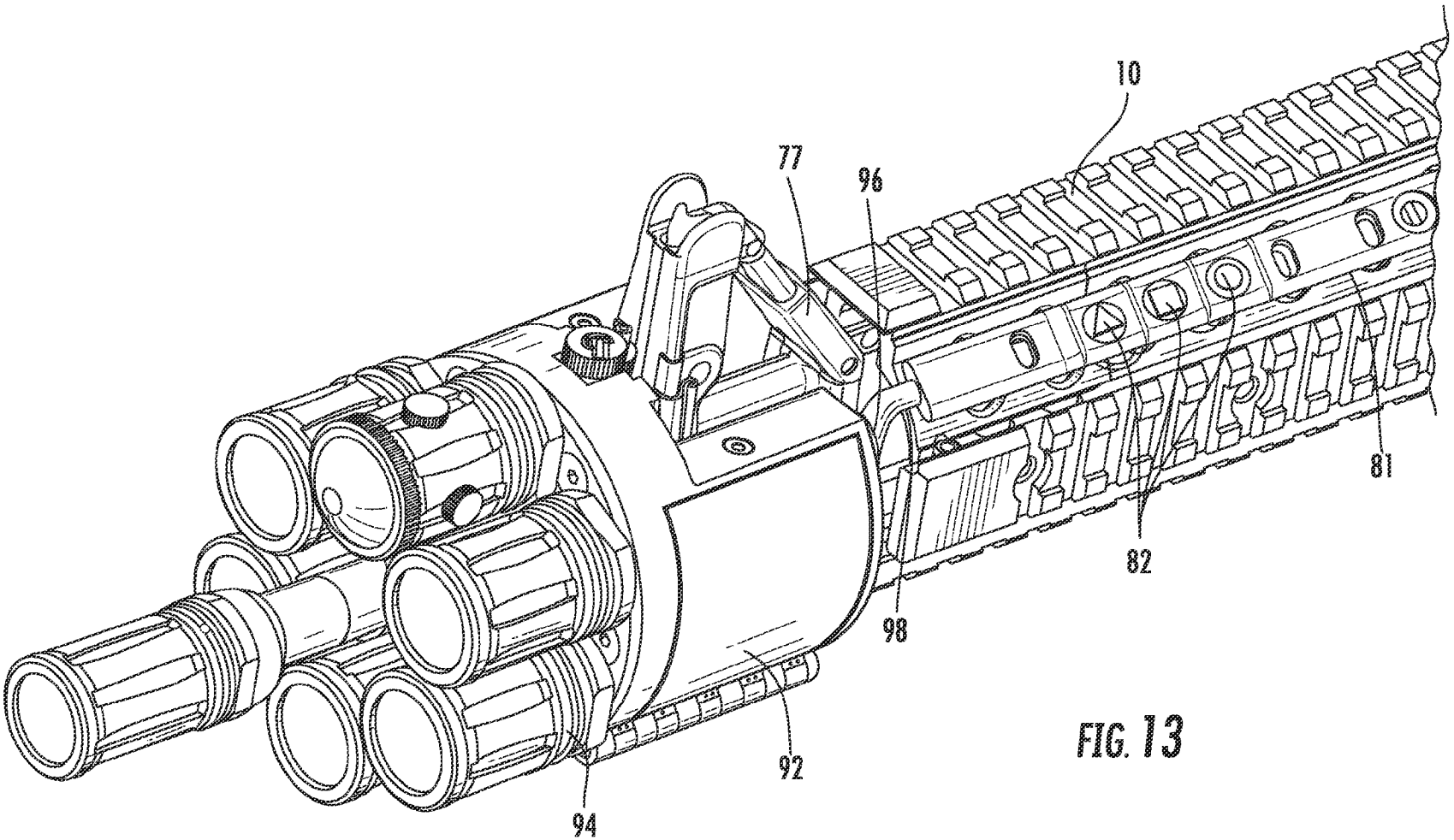
FIG. 13 is a front, perspective view of the modular hand guard assembly with an alternate embodiment of a lighting accessory installed thereon.

In FIG. 12, an alternate embodiment of the switch bar 80A extends the entire length of the hand guard 11 to service an electronic accessory at the front of the firearm 2. It is important to note that the switch bar 80A is intended to be modular such that it can be provided in different lengths of include extensions to allow its flexible use with weapon accessories at the front, middle or rear of the weapon 2. As stated above, the switch bar 80 is intended to control various weapon accessories, such as the weapon light 70 as illustrated at FIG. 7. However, the disclosure is not intended to be limited to the weapon light as illustrated. The switch 80 may be used to control anything electronic that is mounted to the weapon 2.

In FIG. 12, an alternate weapon light 92 is illustrated mounted onto the bayonet lug on the front sight 77 and is positioned adjacent to the front of the hand guard 11. The weapon light 92 includes a plurality of different light heads 94 that can be interchanged. For example, the light heads 94 may be laser emitters, IR lights and/or visible lights. Each type of light is controlled by a separate switch 82. The rear surface of the weapon light 92 is configured to include a mating connection port 96 including contacts that are connected to the control circuitry of the light elements. The connection port 96 of the weapon light 92 is coupled, or plugged into, the connection port 84 of the switch bar 80. In this manner, the switches 82 may control the activation of the various light elements 94. For example, one of the switches 82 (triangle button) may control a laser. Another switch 82 (square button) may control IR light elements. Finally, a third switch 82 (circle button) my control white light elements. A waterproof sleeve or boot 98 may be mounted over the connection ports 96,84 to prevent water or dirt from fouling the connections.

In addition to the specific connections described with respect to the weapon light, the switching device 80 may be used to control any electronic device mounted onto the weapon 2, either at the front or the rear of the weapon 2. The switches and the connection ports can be configured in any manner or arrangement necessary to accommodate the device and the user, and the general concept of the invention should not be limited to the particular configurations as shown.

Therefore, it can be seen that the present invention provides a unique modular hand guard system 10 for mounting accessories to a firearm 2 that allows the lower hand guard 28 to be quickly detachable from the upper hand guard as well as providing a removable upper rail section 30 for rapid deployment of fire arm accessories. It can further be seen that the present invention provides a unique electronic switching and control system for the various electronic accessories that are mounted to the modular hand guard. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A modular hand guard assembly for a firearm comprising:

a hand guard having a forward portion and a rearward portion and a dovetail rail extending between the forward portion and the rearward portion, said handguard further having opposing sidewalls extending outwardly and downwardly from said dovetail rail, said forward portion including a cutout area, said opposing sidewalls including mating formations within said cutout area, said rearward portion being configured and arranged to be secured to said firearm;

an accessory piece including reciprocal mating formations configured and arranged to be received into said forward cutout area and to interlock with said mating formations on said upper hand guard; and a locking mechanism configured and arranged to selectively secure said accessory piece in assembled relation within said cutout area.

2. The modular hand guard assembly of claim 1, wherein said cutout area is located on a top surface of said forward portion and said accessory piece comprises a removable rail section having a dovetail rail extending between a forward and rearward end thereof.

3. The modular hand guard assembly of claim 1, wherein said locking mechanism comprises a pair of locking pins slidably engageable with said mating formations of the hand guard whereby said pair of locking pins selectively lock said accessory piece to said hand guard by preventing said reciprocal mating formations from being disengaged from said mating formations.

4. The modular hand guard assembly of claim 1, further comprising:

a modular switch system positioned on said hand guard, said modular switch system including switches and at least one plug that interfaces with accessories mounted to said hand guard to allow said switches to control said accessory.

5. A modular hand guard assembly for a firearm, said firearm including an upper receiver having a forward end and a rearward end, said upper receiver further including a dovetail rail extending longitudinally between the forward end and the rearward end, said upper receiver still further having a barrel receiving receptacle at a forward end thereof, said firearm further including a barrel received in said barrel receiving receptacle and a barrel nut received around an outer surface of said barrel receiving receptacle, said modular hand guard system comprising:

an upper hand guard having a forward portion and a rearward portion, and further having a dovetail rail extending longitudinally between the forward portion and the rearward portion, said upper handguard further having opposing sidewalls extending outwardly and downwardly from said dovetail rail, said forward portion including a cutout area, said opposing sidewalls including mating formations within said cutout area;

a clamp removably secured to said rearward portion of said upper hand guard to support said upper hand guard on said barrel nut, wherein said upper hand guard extends from said forward end of said upper receiver forwardly above said barrel, and further wherein said dovetail rail of said upper hand guard extends forwardly in linear alignment with said dovetail rail of said upper receiver;

a removable rail section including a dovetail rail and sidewalls that extend outwardly and downwardly from said dovetail rail, said sidewalls of said removable rail section including reciprocal mating formations configured and arranged to be received into said forward cutout area and to interlock with said mating formations on said upper hand guard; and a locking mechanism configured and arranged to selectively secure said removable rail section in assembled relation within said cutout area.

6. A modular hand guard assembly for a firearm, comprising:

an upper hand guard having a forward portion and a rearward portion, a dovetail rail extending between the forward portion and the rearward portion and opposing sidewalls that extend outwardly and downwardly from said dovetail rail, said forward portion including a cutout area, said sidewalls including upper and lower mating formations;

an upper accessory piece including reciprocal mating formations configured and arranged to be received into said forward cutout area and to interlock with said upper mating formations on said upper hand guard; and a lower accessory piece including reciprocal mating formations configured and arranged to interlock with said lower mating formations on said upper hand guard.

7. The modular hand guard assembly of claim 6, further comprising:

a pair of locking pins slidably engageable with said mating formations of the upper hand guard;

whereby said pair of locking pins selectively lock said upper and lower accessory pieces to said upper hand guard by preventing said reciprocal mating formations from being disengaged from said mating formations.

8. The modular hand guard assembly of claim 6, wherein said lower accessory piece is a lower hand guard.

9. The modular hand guard assembly of claim 8, said lower hand guard including a forward portion, a rearward portion, and opposing sidewalls that extend outwardly and upwardly, said reciprocal mating formations extending from the sidewalls.

10. The modular hand guard assembly of claim 8, wherein said lower hand guard further includes a dovetail rail extending from said forward portion to said rearward portion.

11. The modular hand guard assembly of claim 6, wherein said upper accessory is selected from the group consisting of:

visible lights, infrared illuminators, lasers, range finders, accessory weapons, tasers and video cameras.

12. The modular hand guard assembly of claim 11, further comprising:

a modular switch system positioned on said hand guard, said modular switch system including switches and at least one connection port that interfaces with said upper accessory to allow said switches to control said upper accessory.

13. The modular hand guard assembly of claim 12, further comprising:

standoffs on said hand guard; and slots in a rear surface of said modular switch system that engage said stand offs thereby retaining said switch system in an engaged position on said hand guard.

14. The modular rail assembly of claim 6, further comprising:

a modular switch system positioned on said hand guard, said modular switch system including switches and at least one connection port that interfaces with said upper accessory to allow said switches to control said upper accessory.

15. The modular hand guard assembly of claim 14, further comprising:

standoffs on said hand guard; and slots in a rear surface of said modular switch system that engage said stand offs thereby retaining said switch system in an engaged position on said hand guard.

16. The modular hand guard assembly of claim 14, said modular switch system including a plurality of vent holes that extend therethrough and correspond to vent holes in the handguard.

17. The modular hand guard assembly of claim 6, wherein said upper accessory further includes a dovetail rail extending along a top surface thereof.

18. The modular hand guard assembly of claim 6, said upper accessory including a forward portion, a rearward portion, and opposing sidewalls that extend outwardly and downwardly, said reciprocal mating formations extending from the sidewalls.

19. A modular hand guard assembly for a firearm, comprising:

an upper hand guard having a forward portion and a rearward portion, a dovetail rail extending between the forward portion and the rearward portion and opposing sidewalls that extend outwardly and downwardly from said dovetail rail, said forward portion including a cutout area, said sidewalls including upper and lower mating formations;

a removable forward rail section including reciprocal mating formations configured and arranged to be received into said cutout area and to interlock with said upper mating formations on said upper hand guard;

a lower accessory piece including reciprocal mating formations configured and arranged to interlock with said lower mating formations on said upper hand guard; and a pair of locking pins slidably engageable with said mating formations of the upper hand guard, wherein said pair of locking pins selectively lock said forward rail section and lower accessory pieces to said upper hand guard by preventing said reciprocal mating formations from being disengaged from said mating formations.

20. The modular hard guard assembly of claim 19, wherein said lower accessory piece is a lower hand guard.

21. The modular hand guard assembly of claim 20, said lower hand guard including a forward portion, a rearward portion, and opposing sidewalls that extend outwardly and upwardly, said reciprocal mating formations extending from the sidewalls.

22. The modular hand guard assembly of claim 21, wherein said lower hand guard further includes a dovetail rail extending from said forward portion to said rearward portion.

23. The modular hand guard assembly of claim 19, wherein said removable forward rail section can be removed and replaced with an accessory selected from the group consisting of: visible lights, infrared illuminators, lasers, range finders, accessory weapons, tasers and video cameras.

24. The modular hand guard assembly of claim 23, said accessory including a forward portion, a rearward portion, and opposing sidewalls that extend outwardly and downwardly, said reciprocal mating formations extending from the sidewalls.

* * * * *